United States Patent [19]

Nakache et al.

[11] 4,117,704

[45] Oct. 3, 1978

[54] METHOD AND APPARATUS FOR PRODUCING A BENT ANGLE PIECE FROM A SHEET-METAL

[75] Inventors: Robert Nakache, Paris; Christian Lequeux, Thionville, both of France

[73] Assignee: Societe Coil Protection Service, Thionville, France

[21] Appl. No.: 796,656

[22] Filed: May 13, 1977

[51] Int. Cl.[2] ..... B21D 19/04

[52] U.S. Cl. ..... 72/83; 72/84

[58] Field of Search ..... 72/82, 83, 84, 115, 72/117, 483; 113/120 AA

[56] References Cited

U.S. PATENT DOCUMENTS

| | | | |
|---|---|---|---|
| 545,791 | 9/1895 | Gates | 113/120 AA |
| 1,816,357 | 7/1931 | Boye | 72/83 |
| 2,490,880 | 12/1949 | Olson | 72/82 |

FOREIGN PATENT DOCUMENTS

| | | | |
|---|---|---|---|
| 522,974 | 7/1940 | United Kingdom | 113/116 D |

*Primary Examiner*—Lowell A. Larson

[57] ABSTRACT

A method and apparatus for producing a bent angle piece from a sheet-metal. The sheet-metal is shaped into a cylinder 1 split along a generating line so that the ends of the sheet-metal can be overlapping, a portion of the said cylinder is clamped on a support such as a mandrel 3 moving in rotation about the axis of the said cylinder, and during the rotation of the said support, successive areas adjacent the unclamped portion 1*b* of the sheet-metal cylinder are bent progressively either outwardly or inwardly until said unclamped portion reaches a position which is at least nearly perpendicular to the axis 3*a* of the cylindrical portion so as to form an annular flange joined to the cylindrical flange constituted by the portion of cylindrical flange clamped on the support.

16 Claims, 8 Drawing Figures

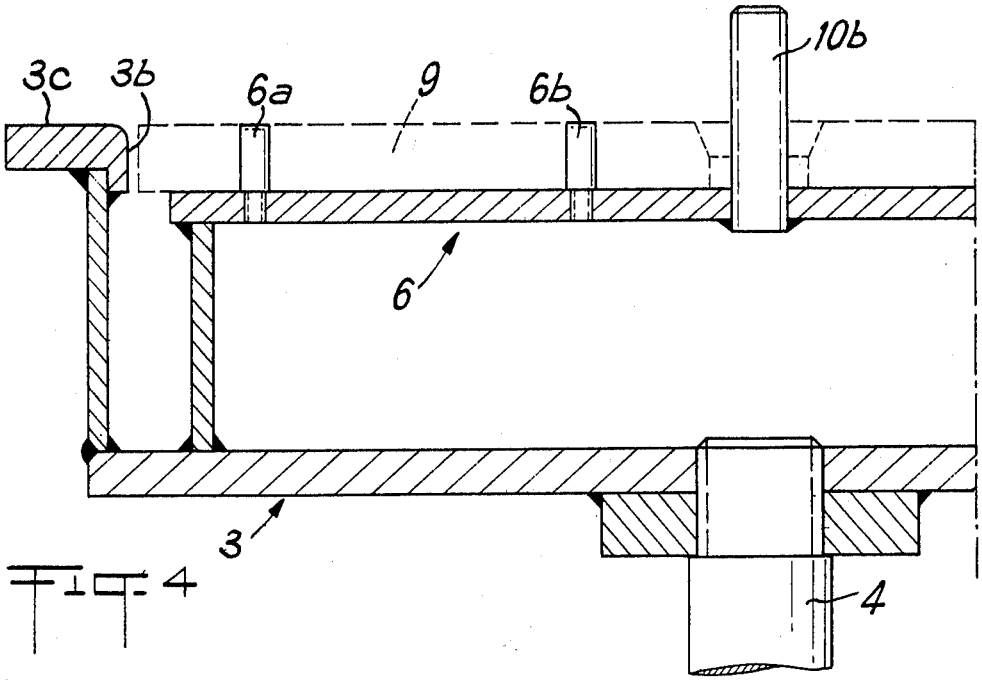
FIG. 4
FIG. 5
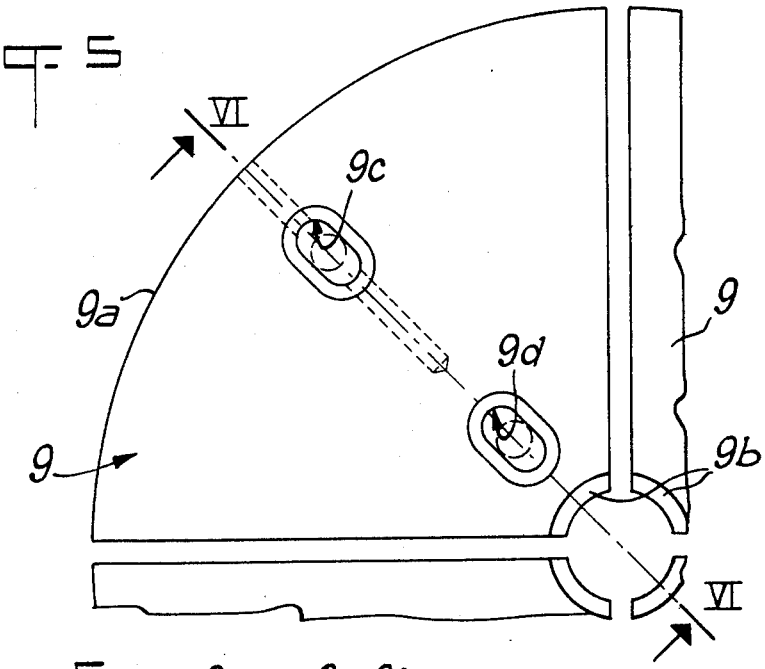
FIG. 6
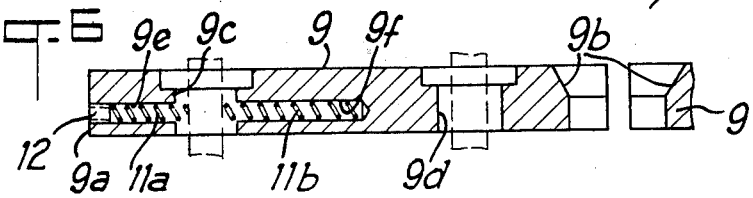

METHOD AND APPARATUS FOR PRODUCING A BENT ANGLE PIECE FROM A SHEET-METAL

The invention relates to a method and apparatus for producing bent angle pieces, preferably cylindrical in shape, whose ends are, capable of being overlapping, and which are produced from sheet-metal or from plane strip-iron.

A method is already known with which to produce from a metallic blank, a bent angle piece preferably cylindrical in shape, one of whose flanges actually defines a cylinder, the other flange being annular-shaped and extending either outwardly, or inwardly in a plane perpendicular to the axis of this cylinder. This known method consists in the partial stamping of an annular sheet-metal blank. In the case of a stamping operation leading to a bent angle piece with an inward flange, the stretching of the metal is considerable and thus it is impossible to obtain a fair sized flange without breakage. The acceptable maximum stretching in such a case is of the order of D/10 to D/7, D being the average diameter of the bent angle piece.

Furthermore, the stamping process involves considerable equipment costs, which become prohibitive when the diameter of the bent angle pieces to be produced is too large. Moreover, this known method requires the use of sheet-metal of even thickness as well as a prior cutting of the annular blanks. In addition to cutting the annular blanks, which operation is relatively expensive, the known method does not permit the use of the circular blanks resulting from the cutting of the annular blanks, when the diameters of the circular blanks have become too small. This known method therefore entails a considerable amount of scraps so that it is not possible to utilize any so-called obsolete sheet-metal. Furthermore, it often leads to local breaking of the annular flanges perpendicular to the axis of the cylinder, especially when the annular flanges are directed towards the said axis inside the cylindrical flange of the bent angle piece.

It is an object of the invention to eliminate all these drawbacks and to propose a method for producing bent angle pieces generally cylindrical in shape from sheet-metal, which method is simple, rapid, avoids scraps, and permits the use of faulty or obsolete sheet-metal.

It is a further object of the invention to enable the production, from sheet-metal or from plane strip-iron, of a bent angle piece having a cylindrical flange and an annular flange, bent angle piece of the type comprising a split throughout its entire length along a generating line so that the two lateral ends of the bent angle piece can be overlapping.

To achieve the above and other of its objects the invention provides a method which includes first shaping a plane sheet-metal into a cylinder split along a generating line, so that the ends of the sheet-metal are overlapping, clamping on a support such as a mandrel moving in rotation about the axis of the said cylinder, that portion of the sheet-metal cylinder which is intended to constitute the cylindrical flange of the bent angle piece, and progressively bending, during the rotation of the said support, successive areas adjacent the unclamped end portion of the sheet-metal cylinder by a thrusting operation either outwardly or inwardly until said unclamped portion reaches a position which is nearly perpendicular to the axis of the cylindrical part.

The invention makes it possible to use relatively fragile sheet-metal even, since during their transformation into angle pieces they are locally subjected to a kind of cold-hammering which increases their mechanical resistance. Moreover, the shaping of the angle pieces being a progressive operation and not a sudden one as with stamping, there is no formation of cracks in the annular flange perpendicular to the cylindrical flange, even when the latter is inwardly directed. This method further permits the use of sheet-metal of uneven thickness.

An essential advantage of the invention lies in the fact that the sheet-metal can be placed on the mandrel without previously exhibiting a permanent cylindrical shape. Thus, during the bending operation, both the annular and the cylindrical flanges are simultaneously produced and when the method is completed the annular flange gives to the angle piece the rigidity necessary to maintain the angle piece in a permanent bent state. However, the bent angle piece can be used as angle end piece on cylindrical bodies of slightly different sizes, since the overlapping of the lateral ends of the angle piece allows an easy adjustment of the diameter of the cylindrical angle piece.

In order to account for a certain elasticity of the bent sheet-metal, which elasticity imparts to the annular flange of the angle piece a tendency to return by a few degrees to its starting position before the progressive bending, the said annular flange is bent until it forms with the axis of the cylindrical flange an angle slightly smaller or greater than 90°, and preferably of the order of 87° or 93°.

The apparatus for producing cylindrical angle pieces from plane sheet-metal comprises a cylindrical mandrel which can be driven in rotation about its axis and adapted to receive the portion of the sheet-metal which is intended to constitute subsequently the cylindrical flange of the angle piece as well as a shaping or bending tool mounted in extension of the mandrel for shaping the plane annular flange of the bent angle piece. The apparatus according to the invention is particularly remarkable in that the cylindrical mandrel is provided with a cylindrical support face and with an annular support face, both faces being integral to each other, in that gripping means act on the portion of sheet-metal which is intended to constitute the cylindrical flange of the bent angle piece in order to fix the said portion on the cylindrical support face of the mandrel, and in that the working tool is mounted for movement in two directions, one being perpendicular to the other and one being perpendicular to the axis of the said mandrel, whilst the other is parallel to the said axis.

Thus, the apparatus according to the invention comprises both means for bending the sheet metal and means for gripping the same whilst the annular flange is formed by the working tool.

The shaping or bending tool is constituted by a wheel whose working face is slightly bent, the tangent to the working face being at an angle of 5° to 8° with respect to the generating line of the cylindrical support face of the mandrel, which generating line crosses the same radial plane as the said tangent to the working face.

The working face rotates about an axis which is either parallel to the axis of the cylindrical support face, or at an angle varying between 65° and 80°, and preferably of the order of 75°.

The shaping or bending tool is mounted on a first carriage moving in a first so-called radial plane which crosses the axis of the cylindrical support face along a first direction parallel to the said axis, said first carriage being itself mounted on a second carriage moving in a plane parallel to the said first plane and in a second direction perpendicular to the said axis and to the said first direction and parallel to the said first plane.

The position of the shaping tool is adjustable on the first carriage so that the axis of rotation of the tool can be adjusted with respect to the axis of the mandrel.

Advantageously, the annular support face of the mandrel is slightly truncated cone-shaped and its generating lines are at an angle of 87° to 93° with respect to the axis of the cylindrical support face of the said mandrel.

The annular support face extends either inwardly or outwardly of the cylindrical volume defined by the cylindrical support face of the mandrel.

Whenever the annular support face is on the outside of the cylindrical support face, the mandrel is hollow and is provided, on the inside the cylindrical face, with a stop plate for the gripping means, comprising a plurality of gripping sectors having the shape of disk sectors and whose periphery can be inscribed in the cylinder defined by the cylindrical support face of the mandrel, said sectors being radially guided on the stop plate and being associated to a separating device supported by the stop plate and acting radially on the gripping sectors.

The separating device of the gripping sectors comprises a hollow wedge with a truncated cone-or pyramid-shaped periphery and a threaded rod mounted on the stop plate, co-axially to the mandrel and crossing the hollow wedge, the inner ends of the said sectors comprising truncated cone-shaped contact faces capable of bearing against the truncated cone-shaped periphery of the said wedge under the effect of a control member supported by the said rod.

Each gripping sector comprises two oblong guide holes aligned radially and for each gripping sector the stop plate comprises two guide studs aligned radially and penetrating without substantial lateral clearance into the oblong guide holes.

At least one of the oblong guide holes communicates, at each end, with a radial opening drilled in the gripping sector and receiving a return spring, the latter bearing, on the one hand against a guide stud and, on the other hand, against the base of the radial opening.

In the case of the mandrel whose annular support face extends inwardly of the cylindrical support face, the gripping means are provided with a support strap and with a gripping belt provided with a gripping lever.

The invention will be more readily understood on reading the following description of the method according to the invention, of an embodiment of the apparatus for producing bent angle pieces and of various different means being part of the said apparatus with reference to the accompanying drawing in which:

FIG. 4 is a radial cross-sectional view illustrating in detail part of the mandrel according to FIG. 3;

FIG. 5 is a plan view of several gripping sectors;

FIG. 6 is a radial cross-section of a gripping sector along the line VI—VI of FIG. 5;

Figure 1:
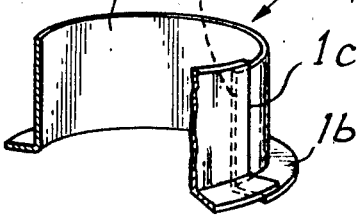
FIG. 1 is a perspective view illustrating a cross-section of a cylindrical angle piece whose annular flange extends outwardly above the cylindrical flange of the angle piece.
Figure 2:
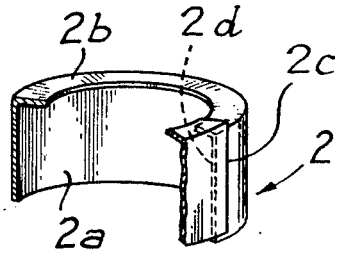
FIG. 2 is a perspective view illustrating a cross-section of a cylindrical angle piece whose annular flange extends inwards above the cylindrical flange of the angle piece.

Referring now to the drawings, FIGS. 1 and 2 each illustrate a portion of the bent angle piece 1 or 2 made from sheet-metal, generally cylindrical in shape and preferably with a circular cross-section, and comprising ends 1*c*, 1*d* or 2*c*, 2*d* which can be slightly overlapping Each angle piece 1 or 2 is composed of a cylindrical flange 1*a* or 2*a* and of an annular flange 1*b* or 2*b* at least approximately perpendicular to the axis of the cylindrical flange 1*a* or 2*a*. The annular flange 1*b* extends outwardly of the cylindrical flange 1*a* (see FIG. 1) whereas annular flange 2*b* extends inwardly of the corresponding cylindrical flange 2*a* (see FIG. 2). The thickness of the sheet-metal used for producing said bent angle pieces is generally between 6/10th and 20/10th mm. The width of the annular flange 1*b* or 2*b* may vary between 40 and 120 mm and is preferably of the order of 60 to 80 mm. The height of the cylindrical flange 1*a* or 2*a* should be sufficient to afford a good fastening on the mandrel, mentioned hereinafter. This height is at least equal to 20 mm. The diameter of the cylindrical flanges 1*a* or 2*a* may vary within a wide range and be between 0.2 and 3.0 meters.

The bent angle pieces 1 or 2 may thus be used for protecting the ends of tubes, reels of sheet-metal, etc..

Figure 3:
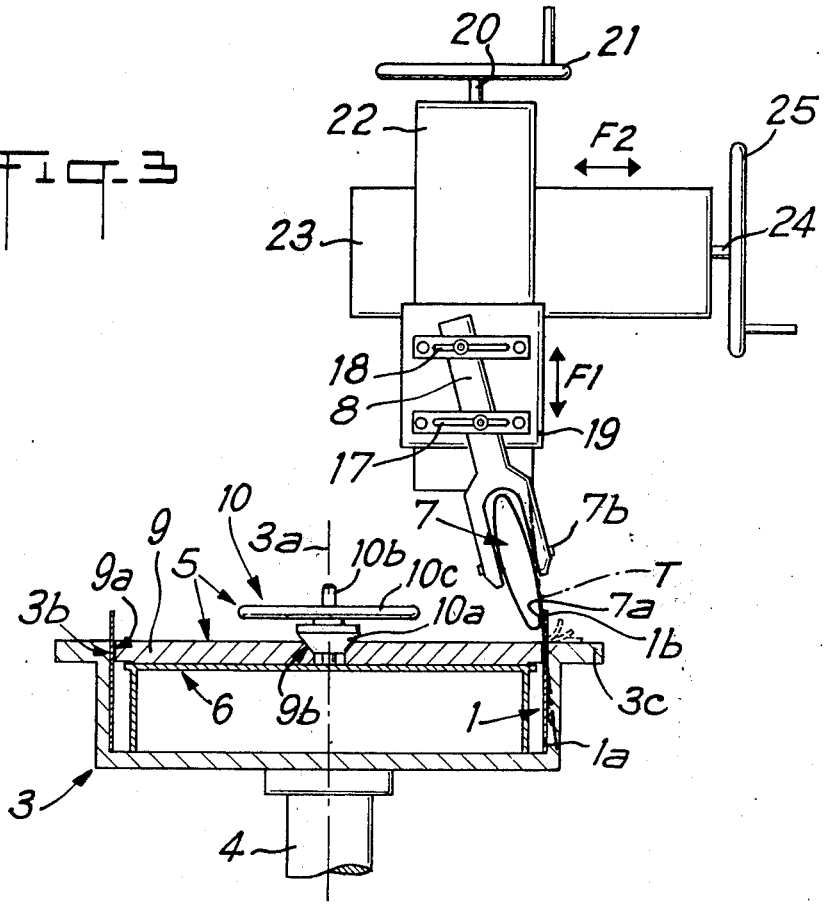
FIG. 3 is a diagrammatical plan view of the apparatus according to the invention, which apparatus comprises a mandrel whose annular support face extends outwardly.

The apparatus for producting said bend angle pieces essentially consists of a hollow, cylindrical mandrel 3 mounted on a rotary shaft 4 driven by means of, for example, a belt-drive and a motor (both not shown), gripping means 5, possibly a stop plate 6 (FIGS. 3 and 4) for the gripping means and a bending tool 7 mounted for movement along two directions $F_1$ and $F_2$ perpendicular to each other, one of which ($F_2$) being perpendicular to the axis of 3*a* of the said mandrel 3, whilst the other ($F_1$) is parallel to said axis 3*a*.

Figure 7:
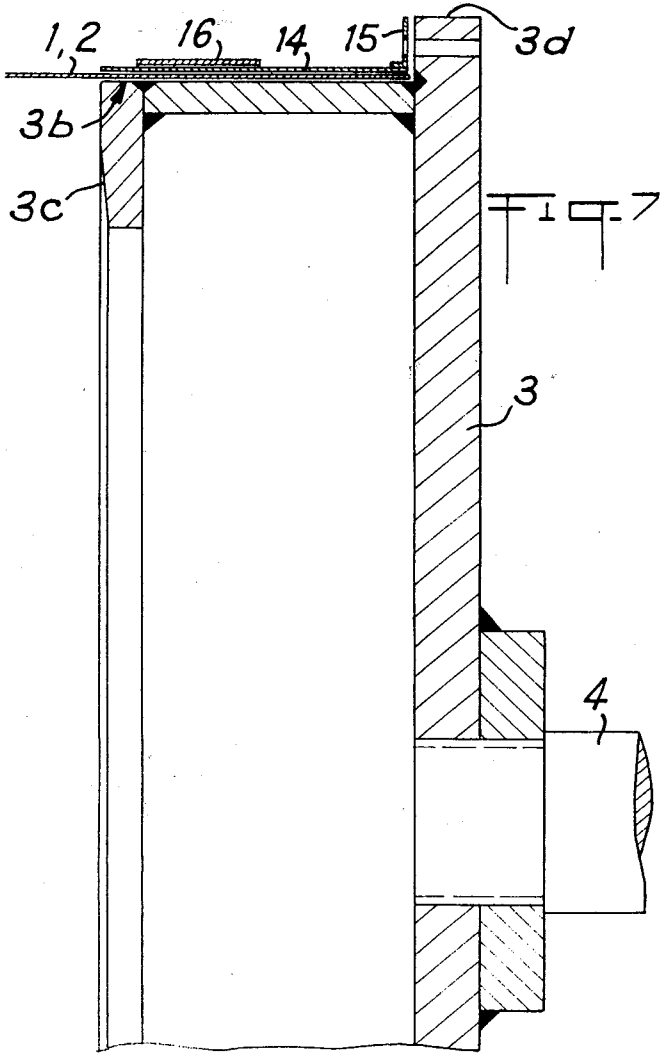
FIG. 7 is a radial cross-sectional view illustrating in detail part of a mandrel whose annular support face extends inwardly.

The hollow mandrel 3 comprises a cylindrical support face 3*b* terminated by an annular support face 3*c* which extends either outwardly (FIGS. 3 and 4), or inwardly (FIG. 7) of the cylinder-shaped support face 3*b*.

When the annular support face 3*c* extends inwardly of the cylindrical support face 3*b*, the mandrel is provided inside the said cylindrical face 3*b* with a stop plate 6 on which gripping sectors 9 are radially guided, which gripping sectors have a cylindrical periphery 9*a* which serves to apply that part of the metal plate which will subsequently constitute the cylindrical flange 1*a* or 2*a* of the angle piece against the cylindrical support face 3*b*. In the vicinity of the axis 3*a* of the mandrel 3, the gripping sectors 9 have a truncated cone-shaped contact face 9*b* against which comes to press the hollow wedge of the truncated-cone-shaped periphery 10*a* of a separating device 10 which is also provided with a threaded rod 10*b* mounted, coaxially to the mandrel 3, on the stop plate 6 and passing through the hollow wedge 10*a* actuated by a fly-wheel 10*c* or control member cooperating with the threaded rod 10*a*.

For each gripping sector 9 shaped as a disk sector, the stop plate 6 comprises two guide studs 6*a*, 6*b*, aligned radially and penetrating with no substantial lateral clearance into one of the two oblong holes 9*c*, 9*d* provided in the sector 9 so as to be also aligned radially, the radial alignment of the two studs 6a and 6b coinciding with that of the corresponding oblong holes 9c and 9d. One of the said oblong holes, preferably the outer one 9c, communicates at each end with a radial opening 9e and 9f drilled in the gripping sector 9 and receiving a return spring 11a and 11b which bears against, on the one hand, the guide stud 6 and, on the other hand, the bottom part of the said radial opening, which bottom part can be constituted by a support screw 12.

In the particular case when the annular support face 3c extends inwardly of the cylindrical support face 3b, the former is preferably given an angle slightly different from 90° with respect to the cylindrical face 3b, but preferably not exceeding 87° or 93°. (See FIG. 7). Also, in this case, the gripping means 5 include a metallic support strap 14, which is cylinder-shaped and of small thickness, secured for example by way of a clamp 15 on an outer shoulder 3d of the mandrel 3 and applied against the cylindrical support face 3b by means of a gripping belt 16 provided with a gripping lever (not shown).

Figure 8:
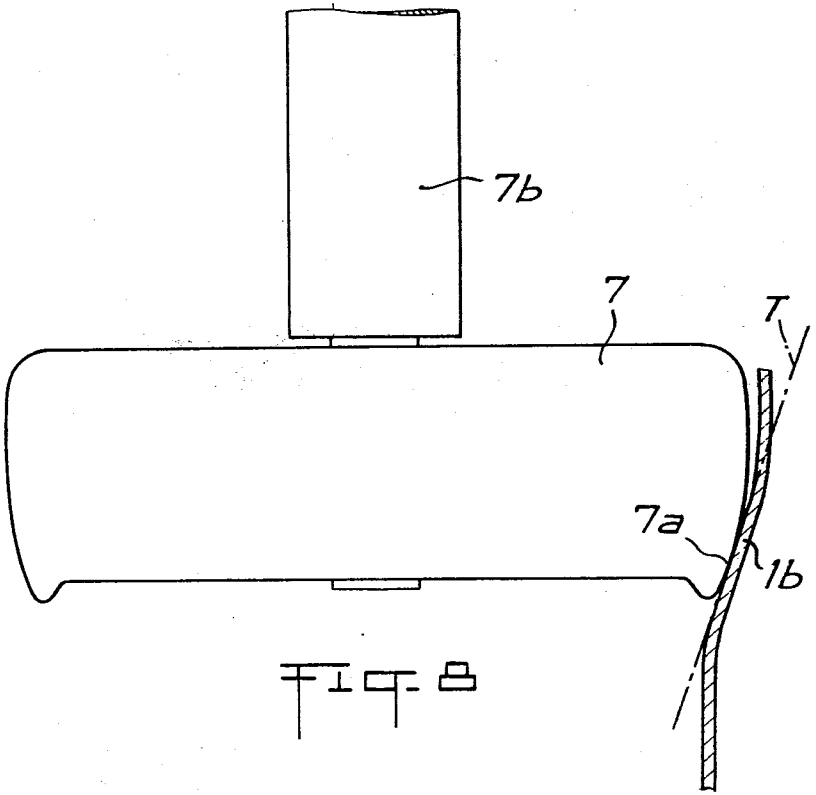
FIG. 8 is a side view of a progressive bending tool.

The bending tool 7 is constituted by a wheel provided with a working face 7a which is slightly bent in the radial plane crossing the axis of the mandrel 3, the tangent T to the working face 7a being at an angle of 5° to 8° with respect to the generating line of the cylinder-shaped support face 3b and crossing the same radial plane containing the axis 3a and the tangent T. The wheel 7 and therefore the working face 7a rotate about an axis 7b which is either parallel to the axis 3a of the mandrel 3 (FIG. 8), or inclined so as to form an angle with the said axis 3a, which angle may vary between 65° and 80° and is preferably of the order of 75°. Said angle of inclination is adjustable due to the fact that the fork 8 supporting the axis 7b of the wheel 7 may be adjusted in two slide guides 17, 18 of a first carriage 19 mounted for movement along the two-way arrow $F_1$ which extends in a radial plane crossing the axis 3a of the mandrel 3, said direction $F_1$ being moreover parallel to the said axis 3a. The sliding movement of the first carriage 19 is controlled by a worm drive and nut 20 actuated for example by a fly-wheel 21 on a second carriage 22 mounted for movement on a fixed support 23. This second carriage 22 may be moved along a direction indicated by the two-way arrow $F_2$ which is perpendicular to the axis 3a of the mandrel 3 and to the direction F1 and is parallel to the radial plane containing the axis 3a and the moving direction of the first carriage 19. The second carriage 22 may also be driven by a worm drive and nut 24, the worm being actuated by a fly-wheel 25. It is evident that other means, which are technically similar, may be used to drive the carriages. In the same way, the separating device could include hydraulic or other means to act on the tightening sectors.

To produce a bent angle piece, a sheet-metal 1 or 2 is first placed in or on the mandrel 3 and gripped between the cylindrical support face 3b and the gripping means 5, after which a working tool 7 is positioned opposite the portion of sheet-metal projecting from the mandrel 3, the latter being then set in rotation so as to have a linear peripheral speed of 4 to 15 m/sec. Simultaneously, the bending tool is moved radially and outwardly with a speed of the order of 1 to 5 mm/sec. During the bending back operation, the portion of sheet-metal, subsequently to constitute the annular flange, progressively adopts the various shapes indicated in broken lines on FIG. 3, before adopting its final shape. It is easily understood that the bending back of the sheet-metal is effected, for one particular localised area, by successive bending or thrusting operations in radial direction, and that between two successive operations for the same area, a bending or thrusting operation is effected over all the peripheral areas of the bending location progressing in the same direction from one particular area to the next and so on.

Certain modification may of course be added to the different embodiments hereinbefore described without departing from the scope of the invention as defined in the accompanying claims. It is obvious that instead of having the sheet-metal to be bent, filing past the working tool, it is equally possible to keep said sheet-metal stationary and to move the working tool both uprightly of the unbent portion of the said plate and along the latter.

What is claimed is:

1. A method for producing, from a plane sheet-metal or a plane strip-iron, a bent angle piece with a cylindrical flange and an annular flange, which angle piece is split over its entire length along a generating line so that the two lateral ends of the angle piece can be overlapping, wherein the plane sheet-metal is first shaped into a cylinder split along a generating line so that the ends of the sheet-metal are overlapping, wherein the portion of the sheet-metal cylinder intended to constitute the cylindrical flange of the angle piece is clamped on a support such as a mandrel moving in rotation about the axis of the cylinder, and wherein whilst the support is rotating, successive areas adjacent the unclamped end portion of the sheet-metal cylinder are progressively bent by a thrusting operation until said unclamped end portion occupies a position which is at least nearly perpendicular to the axis of the cylindrical part.

2. The method as claimed in claim 1, wherein the annular flange is bent by successive deforming operations until it constitutes with the axis of the cylindrical flange an angle slightly different of 90°, preferably of the order of 87° or 93°.

3. An apparatus for producing, from a sheet-metal, a bent angle piece having a cylindrical flange and an annular flange, apparatus of the type comprising a cylindrical mandrel capable of being driven in rotation about its axis and intended to receive the portion of the sheet-metal intended to constitute subsequently the cylindrical flange of the angle piece, and a working tool mounted in front of the mandrel in order to form the plane annular flange of the angle piece, wherein the cylindrical mandrel is provided with a cylindrical support face and with an annular support face, both faces being integral with respect to one another, wherein gripping means act on the portion of sheet-metal which is intended to constitute the cylindrical flange of the angle piece in order to fix the said portion on the cylindrical support face of the mandrel and wherein the working tool is mounted for movement in two directions, one being perpendicular to the other, and one of which is perpendicular to the axis of the said mandrel, whilst the other is parallel to the said axis.

4. The apparatus as claimed in claim 3, wherein the working tool is constituted by a wheel whose working face is slightly bent, the tangent to the working face being at an angle of 5° to 8° with respect to the generating line of the cylindrical support face of the mandrel, which generating line crosses the same radial plane as the said tangent to the working face.

5. The apparatus as claimed in claim 4, wherein the working face of the working tool rotates about an axis which is parallel to the axis of the cylindrical support face.

6. The apparatus as claimed in claim 4, wherein the working face of the working tool rotates about an axis inclined at an angle varying between 65° and 80° and preferably of the order of 75° with respect to the axis of the cylindrical support face.

7. The apparatus as claimed in claim 3, wherein the working tool is mounted on a first carriage moving in a first so-called radial plane crossing through the axis of the cylinder-shaped support face and along a first direction parallel to the said axis, wherein said first carriage is itself mounted on a second carriage moving in a plane parallel to the said first plane and along a second direction perpendicular to the said axis and to the said first direction and parallel to the said first plane.

8. The apparatus as claimed in claim 7, wherein the position of the working tool may be adjusted on the first carriage so that the rotation axis of the tool may be adjusted with respect to the axis of the mandrel.

9. The apparatus as claimed in claim 3, wherein the annular support face of the mandrel is slightly truncated cone-shaped and its generating lines are at an angle of 87° to 93° with respect to the axis of the cylindrical support face of the said mandrel.

10. The apparatus as claimed in claim 3, wherein the annular support face extends inwardly of the cylindrical volume defined by the cylindrical support face of the mandrel.

11. The apparatus as claimed in claim 3, wherein the annular support face extends outwardly of the cylindrical volume defined by the cylindrical support face of the mandrel.

12. The apparatus as claimed in claim 11, wherein the mandrel is hollow and comprises inside the cylindrical face a stop plate for the gripping means comprising a plurality of gripping sectors which are in the shape of disk sectors and are able to be inscribed by their periphery in the cylinder defined by the cylindrical support face of the mandrel and which are associated to a separating device bearing against the stop plate and acting radially on the gripping sectors.

13. The apparatus as claimed in claim 12, wherein the separating device of the gripping sectors comprises a hollow wedge whose periphery is preferably truncated cone-shaped and a threaded rod mounted on the stop plate coaxially to the mandrel and crossing through the hollow wedge, the inner ends of the said sectors comprising contact faces able to come to bear against the periphery of the said wedge under the effect of a control member supported by the said rod.

14. The apparatus as claimed in claim 12, wherein each gripping sector comprises two oblong guide holes aligned radially and the stop plate comprises for each gripping sector two guide studs aligned radially and penetrating without substantial lateral clearance in the oblong guide holes.

15. The apparatus as claimed in claim 14, wherein at least one of the oblong guide holes communicate at each end, with a radial opening provided in the gripping sector and receiving a return spring resting on the one hand, against a guide stud and, on the other hand, against the base of the radial opening.

16. Apparatus as claimed in claim 10, wherein the gripping means comprise a supporting strap and a gripping belt provided with a gripping lever.

* * * * *